US008528280B2

(12) United States Patent
Coil et al.

(10) Patent No.: US 8,528,280 B2
(45) Date of Patent: Sep. 10, 2013

(54) COMPOSITE HUTCH DOOR

(75) Inventors: Robert Coil, Columbus Junction, IA (US); Travis E. Wright, Morning Sun, IA (US)

(73) Assignee: HNI Technologies Inc., Muscatine, IA (US)

( * ) Notice: Subject to any disclaimer, the term of this patent is extended or adjusted under 35 U.S.C. 154(b) by 0 days.

(21) Appl. No.: 13/396,006

(22) Filed: Feb. 14, 2012

(65) Prior Publication Data

US 2013/0014456 A1 Jan. 17, 2013

Related U.S. Application Data

(60) Provisional application No. 61/442,712, filed on Feb. 14, 2011.

(51) Int. Cl.

| | |
|---|---|
| ***E06B 1/04*** | (2006.01) |
| ***E06B 3/30*** | (2006.01) |
| ***E06B 7/00*** | (2006.01) |

(52) U.S. Cl.

USPC ..... 52/204.1; 52/204.71; 52/204.705; 52/213; 52/204.53; 52/204.54

(58) Field of Classification Search

USPC ..... 52/204.1, 204.71, 204.705, 213, 52/204.53, 204.54

See application file for complete search history.

(56) References Cited

U.S. PATENT DOCUMENTS

| | | | | |
|---|---|---|---|---|
| 3,877,765 | A | 4/1975 | Hassing | |
| 5,323,579 | A | 6/1994 | Ruff | |
| 5,558,418 | A | 9/1996 | Lambright et al. | |
| 5,894,706 | A | 4/1999 | Herbst | |
| 7,331,142 | B2 * | 2/2008 | Gerard | 49/505 |

OTHER PUBLICATIONS

International Search Report and Written Opinion issued in PCT/US2012/024994, mailed May 29, 2012, 9 pages.

* cited by examiner

*Primary Examiner* — Mark Wendell
(74) *Attorney, Agent, or Firm* — Faegre Baker Daniels LLP

(57) ABSTRACT

A door as provided includes a one piece molded outer frame, a transparent panel, and a one piece molded inner frame, the inner and outer frames being coupled via a clip component and clip receiving component with the transparent panel secured therebetween.

6 Claims, 14 Drawing Sheets

COMPOSITE HUTCH DOOR

CROSS REFERENCE TO RELATED APPLICATIONS

This application claims priority to U.S. Application No. 61/442,712, filed Feb. 14, 2011, the contents of which are herein incorporated by reference in their entirety.

TECHNICAL FIELD

Embodiments of the present invention relate generally to office furniture, and more specifically to a composite hutch door.

SUMMARY

Provided herein is a door including a one piece molded outer frame having a framing member, each framing member having a front edge, an inner face, and a back edge; a one piece molded inner frame having a framing member; and a transparent panel secured therebetween, the outer frame and inner frames being coupled via a clip component and clip receiving component. In some embodiments, the outer frame includes the clip component attached to the framing member of the outer frame.

In some embodiments, the clip component includes an anchor section attached to the inner face of an outer frame framing member; an engaging section including a inner face, a front edge, and a back edge, the front edge of the engaging section attached to the anchor section; and a wedge-shaped locking section having a wide end and a narrow end, the locking section being attached to the inner face of the engaging section.

In some embodiments, the inner frame includes the clip receiving component attached to the framing member of the inner frame. In some embodiments, the clip receiving component includes an aperture and a lip configured to lock the clip component into the clip receiving component.

In some embodiments, the inner frame is dimensioned to fit within the outer frame.

In some embodiments, the door includes a hinge receiving component molded into the inner frame.

In some embodiments, at least one of the inner frame and outer frame comprises a polymer or a metal.

Also provided is a method of assembling a door. The method includes securing a transparent panel between a one piece molded outer frame and a one piece molded inner frame, where the outer frame and inner frame are coupled via a clip component and clip receiving component.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

DETAILED DESCRIPTION

Figure 1:
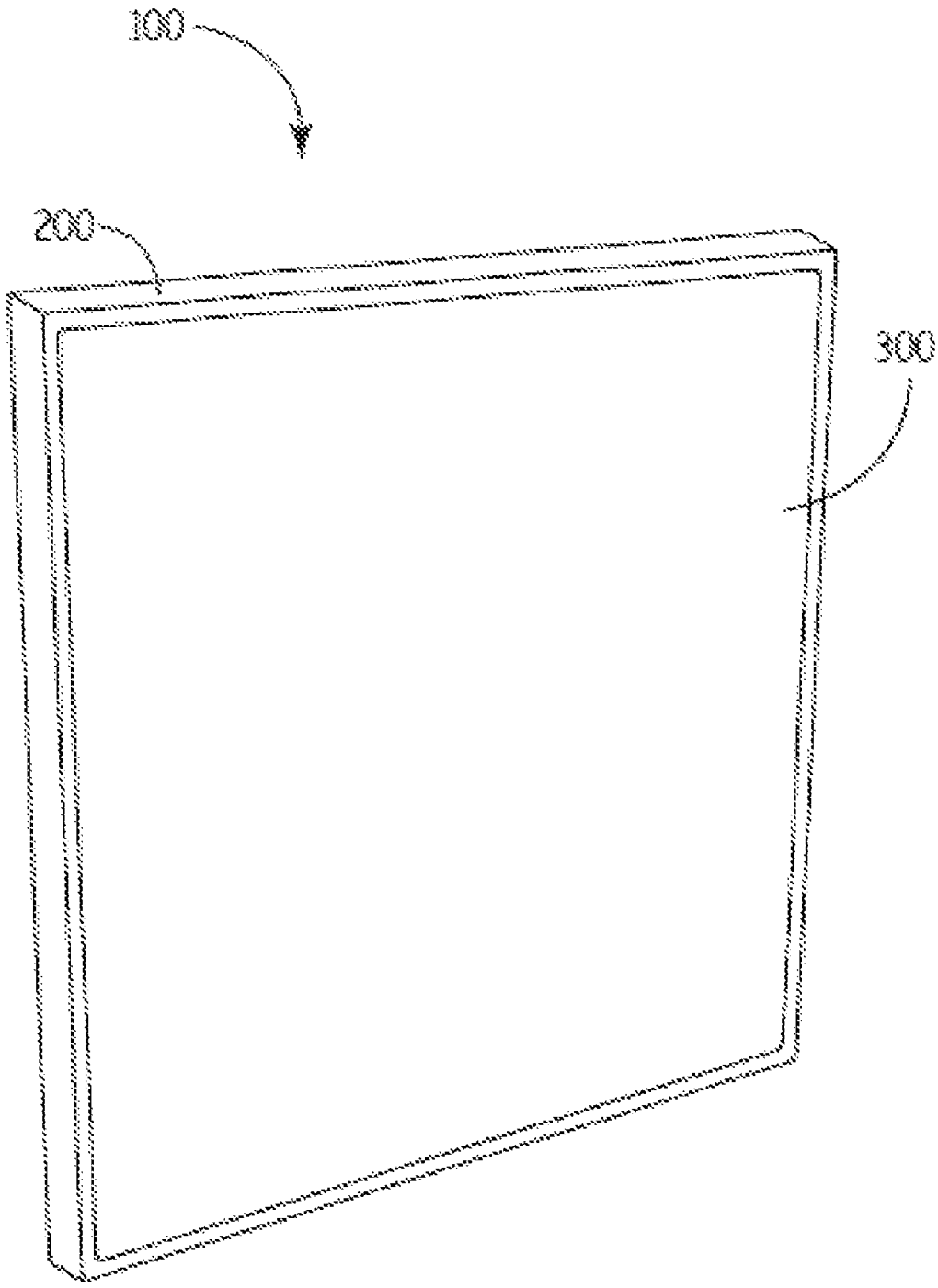
FIG. 1 is a front view of a composite hutch door according to one embodiment.
Figure 2:
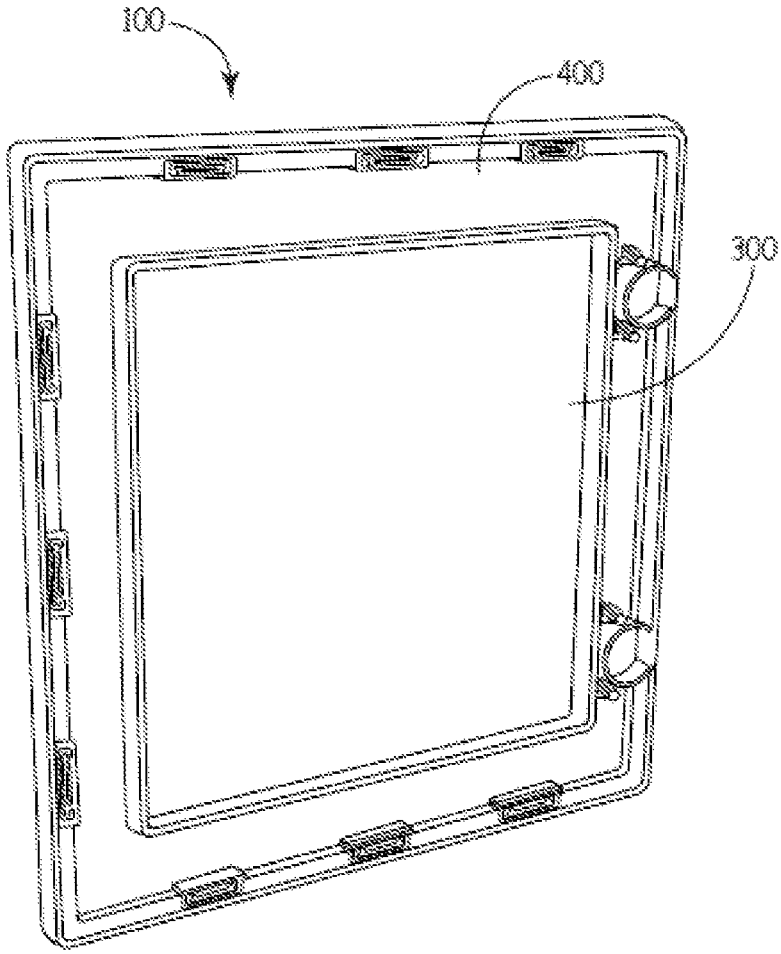
FIG. 2 is a rear view of the composite hutch door according to the embodiment shown in FIG. 1.

Embodiments of the present invention relate generally to office furniture, and more specifically to a door (e.g., hutch or cabinet door) which includes an inner frame, a transparent panel, and an outer frame. FIGS. 1-7A depict a door 100 according to embodiments of the present invention. As illustrated in FIGS. 1 and 2, door 100 includes an outer frame 200 and an inner frame 400 with a transparent panel 300 interposed therebetween.

As used herein, the term "couple" is used in its broadest sense to refer to elements which are connected, attached, and/or engaged, either directly or integrally or indirectly via other elements, and either permanently, temporarily, or removably.

As illustrated in FIGS. 3A-3E, outer frame 200 is molded as a single piece. Outer frame 200 includes first and second vertical parallel framing members 202, 204 and first and second horizontal parallel framing members 206, 208 defining a generally rectangular shaped frame. The framing members 202, 204, 206, 208 have front edges 202*f*, 204*f*, 206*f*, 208*f*, inner faces 202*i*, 204*i*, 206*i*, 208*i*, and back edges 202*b*, 204*b*, 206*b*, 208*b*. Each framing member 202, 204, 206, 208 includes a flange 210 projecting laterally from the front edge 202*f*, 204*f*, 206*f*, 208*f* toward the opposite framing member.

Outer frame 200 additionally includes a clip component 220 on the inner face of at least two of the framing members 202, 204, 206, 208. If a clip component 220 is included on only two framing members of outer frame 200, a clip component 220 is preferably included on the inner face of each of two opposing framing members (i.e., vertical framing members 202, 204 or horizontal framing members 206, 208). In some embodiments, more than one clip component 220 is included on the inner face of a framing member.

Figure 3A:
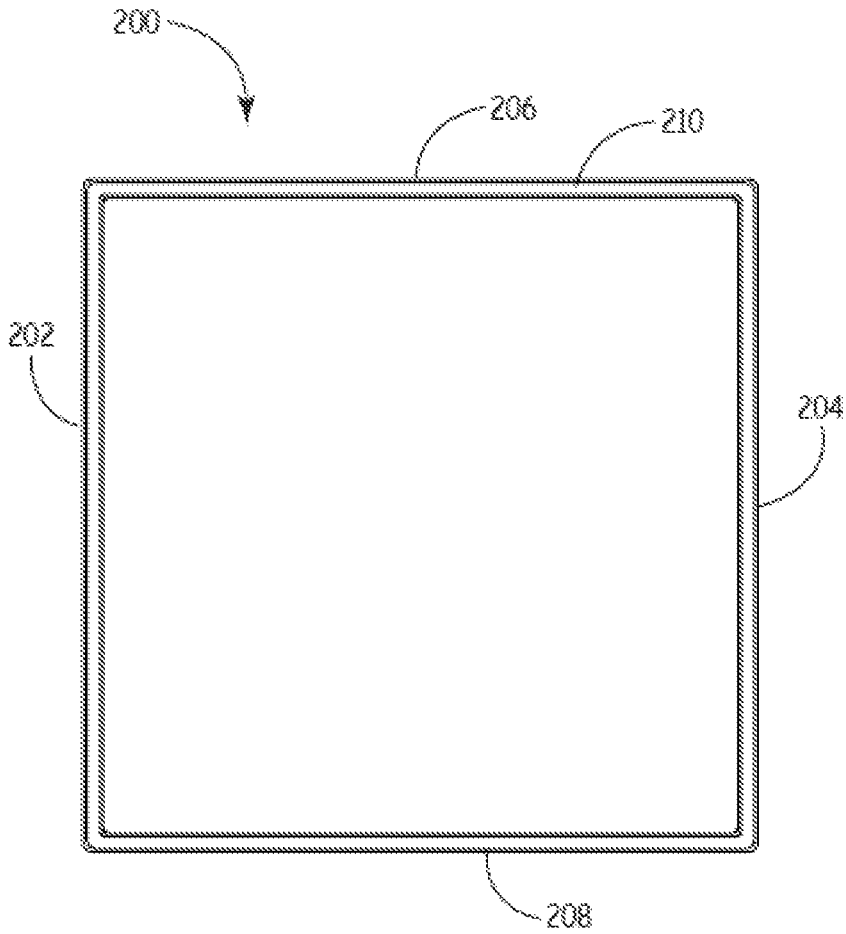
FIG. 3A is a front view of an outer frame according to one embodiment.
Figure 3B:
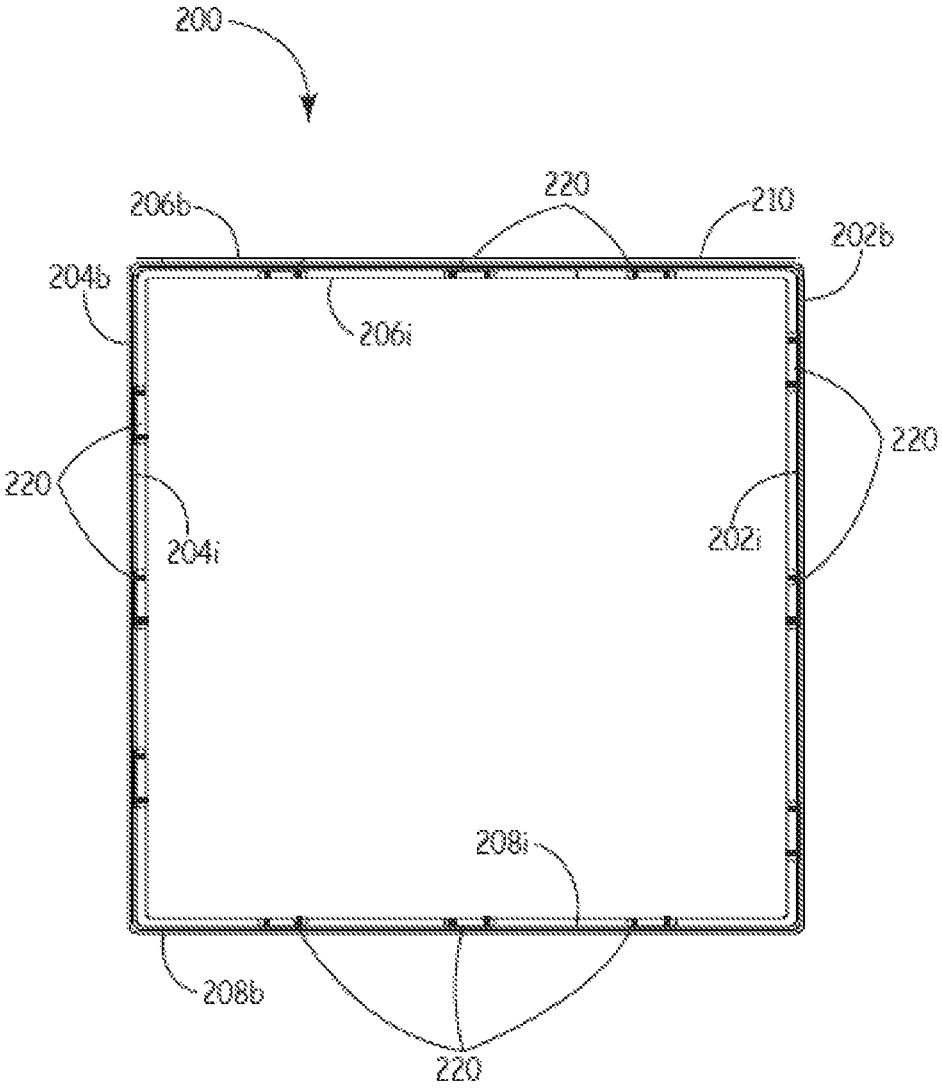
FIG. 3B is a back view of the outer frame according to the embodiment shown in FIG. 3A.
Figure 3C:
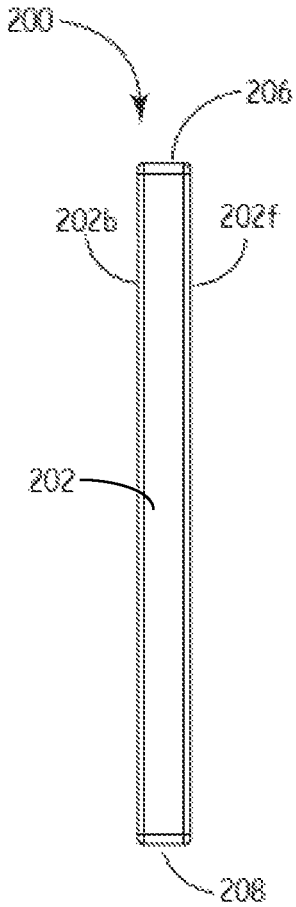
FIG. 3C is a side view of the outer frame according to the embodiment shown in FIG. 3A.
Figure 3D:
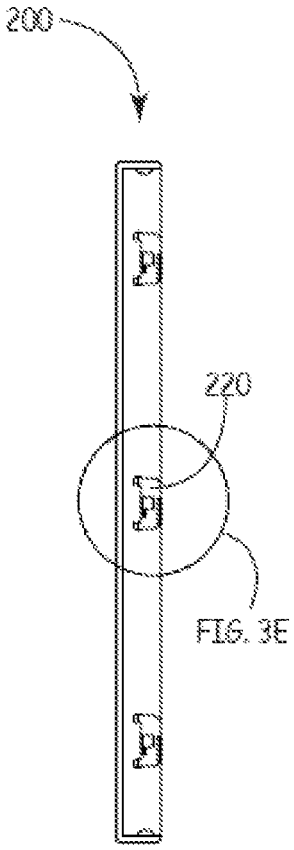
FIG. 3D is a cross sectional side view of the outer frame.
Figure 3E:
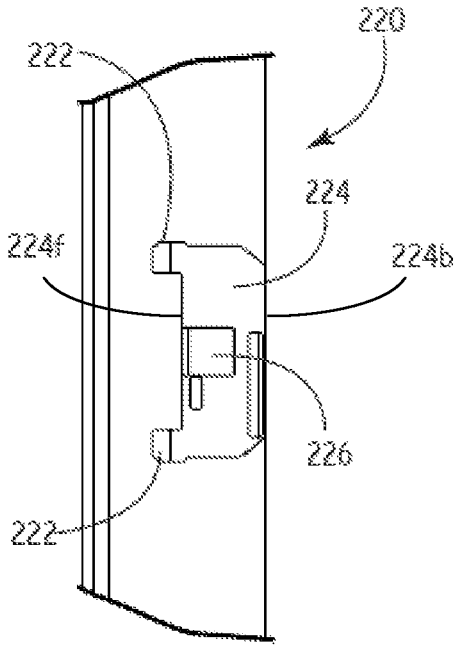
FIG. 3E is a cross sectional side view of the outer frame and showing detail of a clip component according to the embodiment shown in FIG. 3A.
Figure 7:
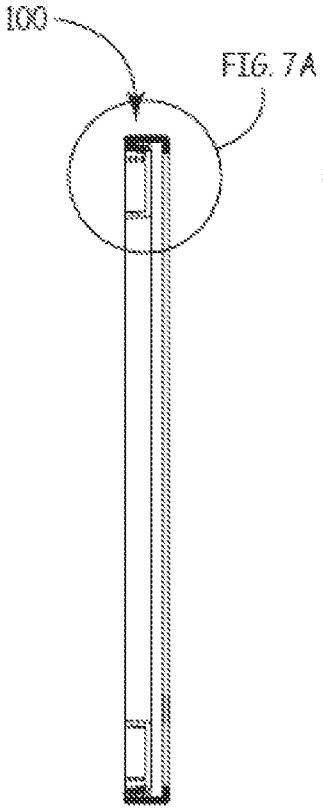
FIG. 7 is a cross sectional side view of a composite hutch door according to one embodiment.
Figure 7A:
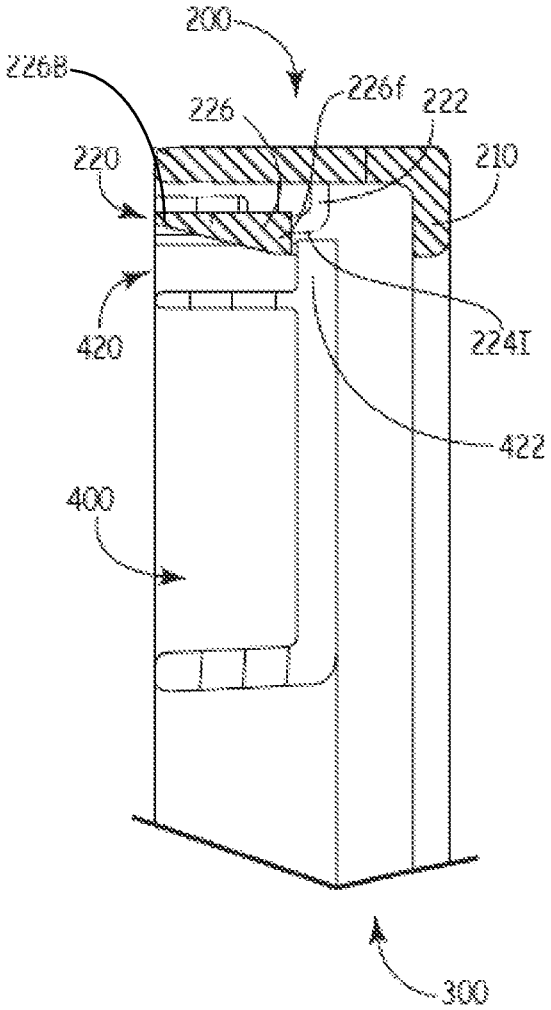
FIG. 7A is a cross sectional side view of the composite hutch door according to the embodiment shown in FIG. 7 showing a close up view of engaged clip components of the outer and inner frames.

FIG. 3D is a cutaway side view of outer frame 200 showing clip component 220. As illustrated in FIGS. 3E and 7A, clip component 220 includes an anchor section 222, an engaging section 224 including a inner face 224*i*, a front edge 224*f*, and a back edge 224*b*, and a wedge-shaped locking section 226 having a wide end 226*f* and a narrow end 226*b*. Anchor section 222 attaches to the inner face of the framing member and connects with at least a portion of front edge 224*f* of engaging section 224, which extends from where it attaches to anchor section 222 generally parallel with the inner face of the framing member toward the back of the door 100 when assembled, but not beyond the back edge of the framing member. Locking section 226 is attached to inner face 224*i* of engaging section 224 such that the wide end 226*f* of locking section 226 is positioned nearer to the front edge 224*f* of engaging section 224 relative to the narrow end 226*b*. Locking section 226 of clip component 220 is oriented such that the wide end 226*f* extends further from the inner face 224*i* of engaging section 224 than the narrow end 226*b*.

Figure 6:
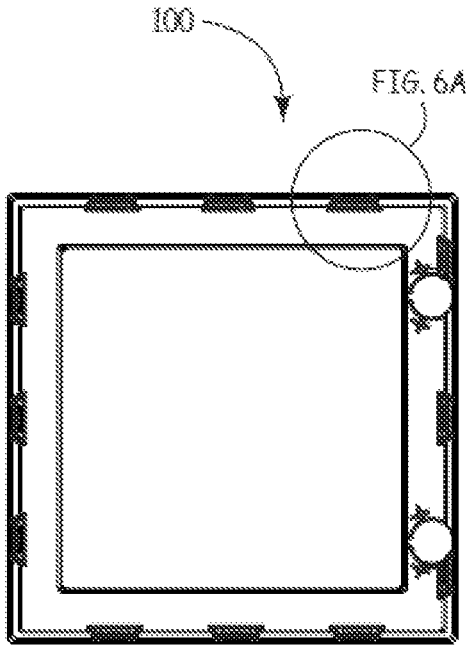
FIG. 6 is back view of a composite hutch door according to one embodiment.
Figure 6A:
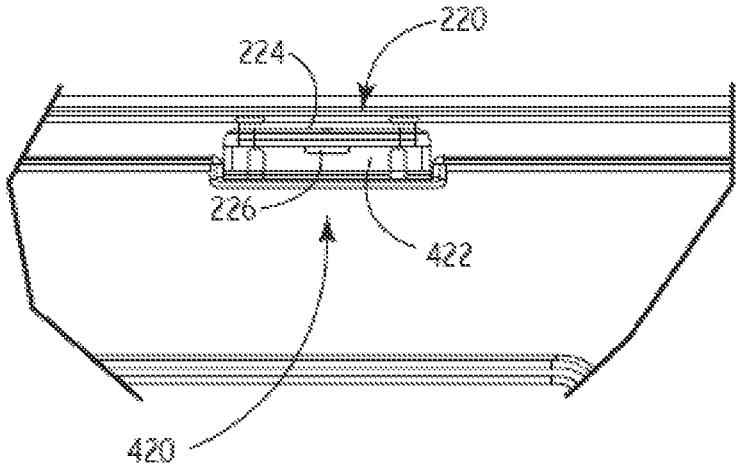
FIG. 6A is a back view of the composite hutch door according to the embodiment shown in FIG. 6 showing a close up view of engaged clip components of the outer and inner frames.

As illustrated in FIGS. 4A-4E, inner frame 400 is molded as a single piece Inner frame 400 includes first and second vertical parallel framing members 402, 404 and first and second horizontal parallel framing members 406, 408 defining a generally rectangular shaped frame. The framing members 402, 404, 406, 408 have front faces 402*f*, 404*f*, 406*f*, 408*f*, outer edges 402*o*, 404*o*, 406*o*, 408*o*, inner edges 402*i*, 404*i*, 406*i*, 408*i*, and back faces 402*b*, 404*b*, 406*b*, 408*b*. At least two framing members 402, 404, 406, 408 of inner frame 400 include a clip receiving component 420 that extends from the outer edge of the framing members toward the back of the door 100 when assembled, and is configured to couple and lock with clip components 220 on the outer frame 200. In some embodiments, as illustrated in FIGS. 6A and 7A, clip receiving component 420 is an aperture including a lip 422, which is configured to allow insertion of clip component 220 with the wide end 226*f* of locking section 226 locking clip component 220 into clip receiving component 420. See FIG. 7, showing a cutaway section of outer frame 200 and inner frame 400 coupled via clip component 220 and clip receiving component 420.

Figure 4A:
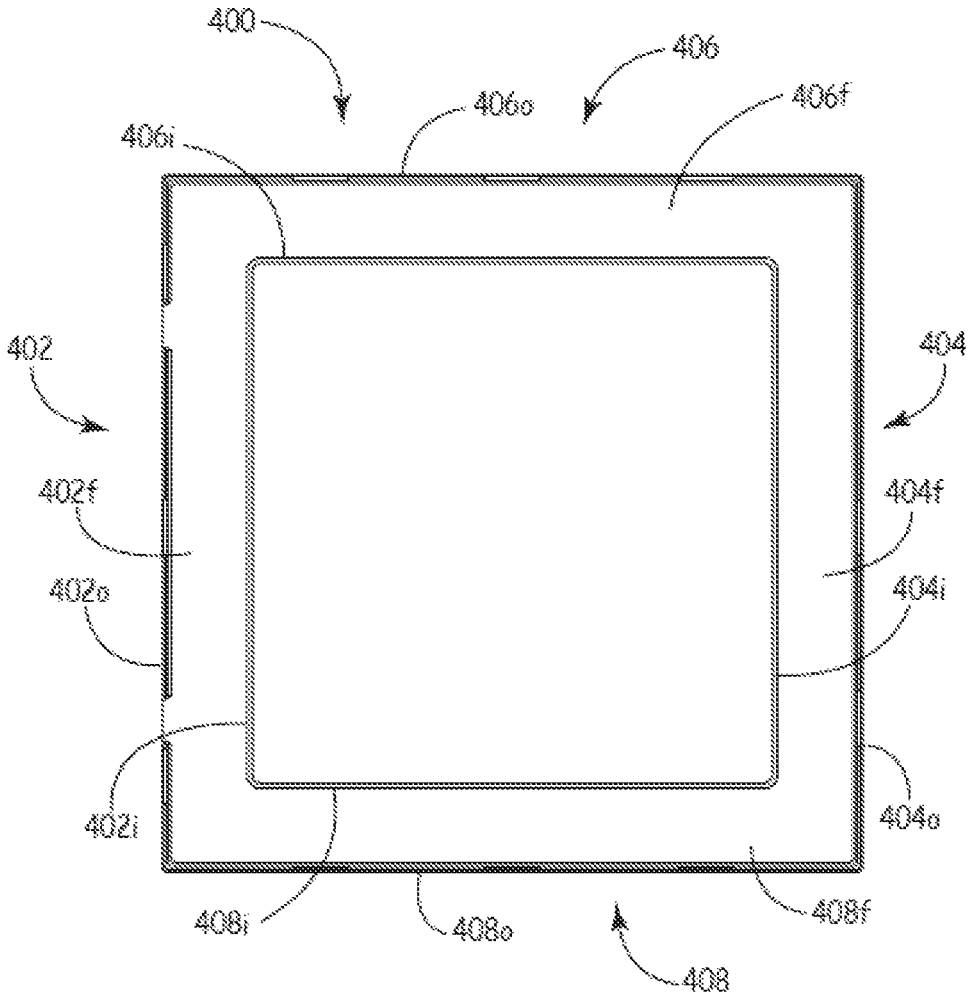
FIG. 4A is a front view of an inner frame according to one embodiment.
Figure 4B:
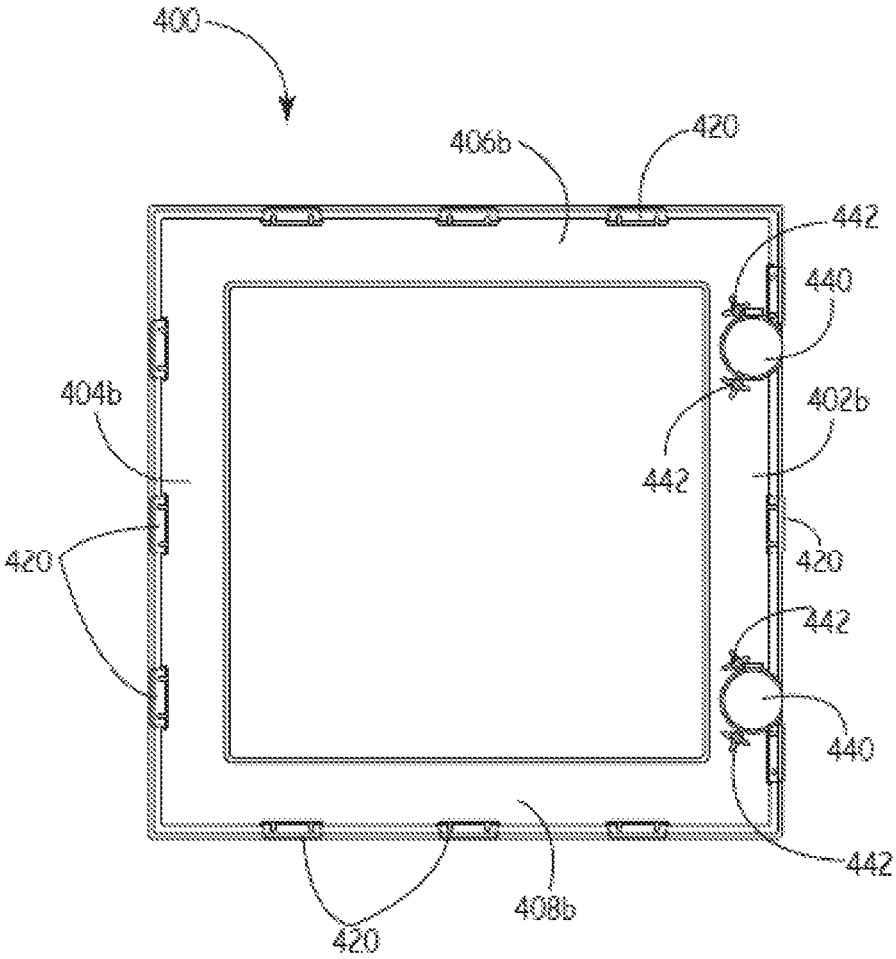
FIG. 4B is a back view of the inner frame according to the embodiment shown in FIG. 4A.
Figure 4C:
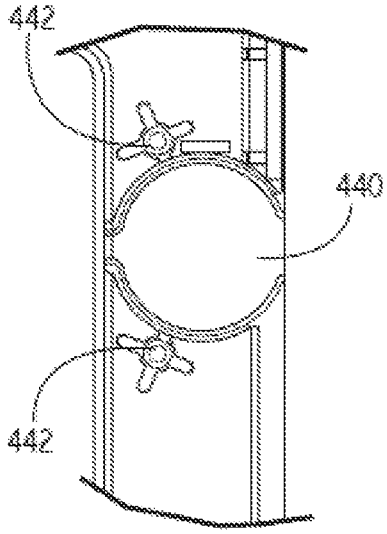
FIG. 4C is a close up view of a hinge receiver component on the back surface of the inner frame according to the embodiment shown in FIG. 4A.
Figure 4D:
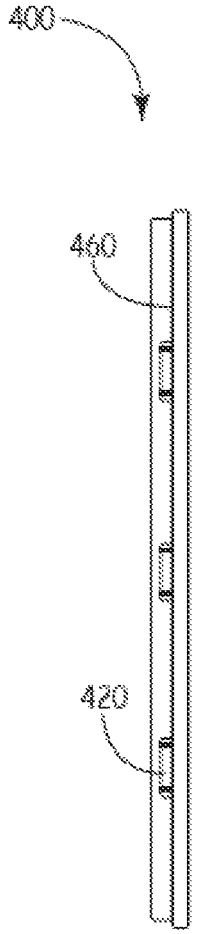
FIG. 4D is a side view of the inner frame according to the embodiment shown in FIG. 4A.

As shown in FIGS. 4B and 4C, outer frame 400 additionally includes a hinge receiving component 440 located on back face 402*b* of framing member 402. In some embodiments, hinge receiving component 440 is an aperture for receiving a hinge (not shown) that extends from back face 402*b*. In other embodiments, hinge receiving component 440 is recessed into back face 402*b*. In some embodiments, hinge receiving component 440 is associated with additional components, such as components useful for facilitating attachment of a hinge to back face 402*b*. For example, in some embodiments as shown in FIGS. 4B and 4C, hinge receiving component 440 is associated with receptacles 442 for screws or bolts.

Figure 4E:
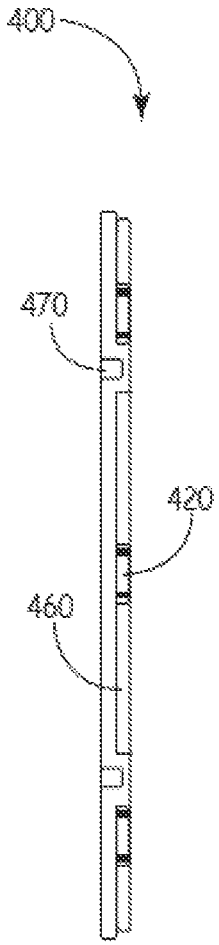
FIG. 4E is a second side view of the inner frame according to the embodiment shown in FIG. 4A.
Figure 5:
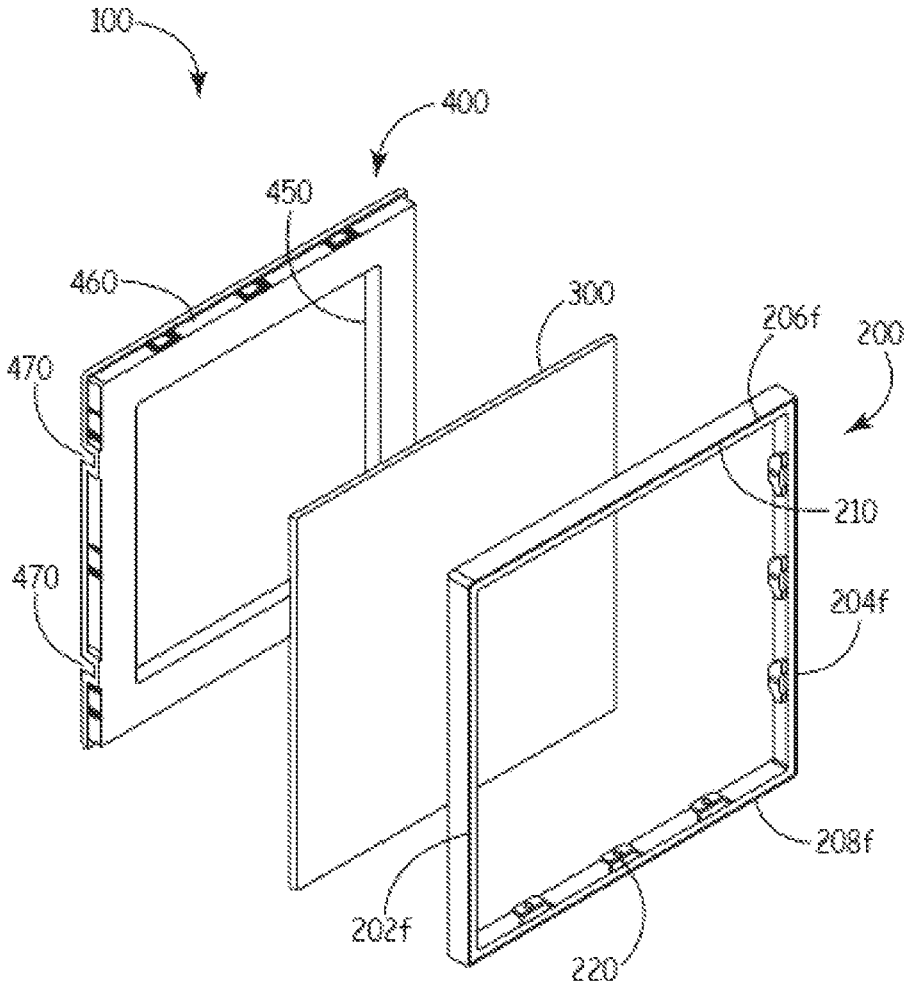
FIG. 5 is an exploded view of a composite hutch door according to one embodiment.

In some embodiments, one or both of molded frames 200 and 400 include elements for strengthening the structure of frames 200 and 400. For example, in some embodiments, inner frame 400 includes an integrally molded inner lip 450 extending backward from the inner edges 402*i*, 404*i*, 406*i*, 408*i* of framing members 402, 404, 406, 408, as illustrated in FIG. 5. In some embodiments, inner frame 400 includes an integrally molded outer lip 460 containing clip receiving components 420 and extending backward from the outer edges 402*o*, 404*o*, 406*o*, 408*o* of framing members 402, 404, 406, 408. Inner and outer lips 450, 460 can be shaped as appropriate to provide structural strength. As shown in FIG. 4E, in some embodiments, outer lip 460 includes additional features, such as an opening 470 to accommodate a hinge portion.

Transparent panel 300 is dimensioned such that transparent panel 300 fits within outer frame 200. Outer frame 200 and inner frame 400 are configured to secure transparent panel 300 between them when door 100 is assembled as shown in FIG. 5, preventing transparent pane 300 from passing through the opening defined by flange 210 of the outer frame 200 and the opening defined by inner edges 402*i*, 404*i*, 406*i*, 408*i* of inner frame 400. The outer and inner frames are further dimensioned such that inner frame 400 fits within the opening defined by inner faces 202*i*, 204*i*, 206*i*, 208*i* of outer frame 200 and clip components 220 couple with clip receiving components 420. See FIGS. 6 and 7, showing clip components 220 coupled with clip receiving components 420 in assembled door 100.

Flange 210 of the outer frame 200 can be dimensioned to provide an opening of a desired size through which transparent pane 300 can be viewed. Similarly, the opening defined by inner edges 402*i*, 404*i*, 406*i*, 408*i* of inner frame 400 can be dimensioned to provide an opening of a desired size through which transparent pane 300 can be viewed. The openings defined by flange 210 and inner edges 402*i*, 404*i*, 406*i*, 408*i* can be the same or different sizes. In some embodiments, the opening defined by inner edges 402*i*, 404*i*, 406*i*, 408*i* can be smaller than the opening defined by flange 210. In some embodiments, flange 210 and/or inner edges 402*i*, 404*i*, 406*i*, 408*i* can be shaped to provide a desired appearance of the respective opening.

Inner and outer frames 200, 400 are molded from any appropriate material as desired for strength and/or flexibility. For example, a material can be selected to be rigid enough to support a pane of glass, yet flexible enough to allow clip component 220 to slide into clip receiving component 420 and resilient enough to allow clip component 220 to lock into clip receiving component 420 once engaged. Materials suitable for molded frames 200, 400 include, without limitation, polymers (e.g., ABS, nylon, polycarbonate, polycarbonate/acrylic alloys, TPO, polycarbonate/PBT alloys, modified PPOs, modified PPEs, polypropylene, polypropylene copolymers, and the like) and metals (e.g., aluminum, stainless steel).

Transparent panel 300 can be made from any suitable material, such as glass or plexiglass. In some embodiments, transparent panel 300 is semitransparent (e.g., frosted). In other embodiments, transparent is fully transparent.

Door 100 is dimensioned as appropriate for use with a selected opening. In one embodiment, door 100 is dimensioned to cover an opening to a cabinet. In another embodiment, door 100 is dimensioned to fit in a doorway. Outer frame 200, inner frame 400, and transparent panel 300 are dimensioned as appropriate to accommodate the overall door 100 dimensions, and can be adjusted to provide the desired properties (e.g., weight, strength, aesthetic properties) in the assembled door 100. In one embodiment, door 100 is dimensioned for use as a cabinet door having a height of about 14 to about 15 inches (e.g., about 14.5 inches), a width of about 14 to about 15 inches (e.g., about 14.5 inches), and a depth of about 0.5 to about 1.5 inches (e.g., about 1 inch). In another embodiment, door 100 is dimensioned for use as a door having a height of about 16 to about 20 inches (e.g., about 18 inches), a width of about 15 to about 19 inches (e.g., about 17 inches), and a depth of about 0.5 inches to about 1 inch (e.g., about 0.75 inches). In other embodiments, door 100 can be dimensioned to be larger or smaller, depending on the size of the opening that door 100 is designed to cover.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

The following is claimed:

1. A door, comprising:

a one piece molded outer frame comprising a framing member having a front edge, an inner face, a back edge, and a clip component, the clip component including, an anchor section attached to the inner face of the outer frame framing member;

an engaging section including an inner face, a front edge, and a back edge, the front edge of the engaging section attached to the anchor section and extending generally parallel to the inner face of the outer frame; and a wedge-shaped locking section having a wide end and a narrow end, the locking section being attached to the inner face of the engaging section and being oriented such that the wide end extends further from the inner face of the engaging section than the narrow end;

a one piece molded inner frame comprising a framing member having a front face, a back face, an outer edge, an inner edge, and a clip receiving component, the clip receiving component including, an aperture extending from the outer edge of the inner frame framing member and a lip configured to lock the clip component into the clip receiving component; and a transparent panel secured therebetween, the outer frame and inner frame being coupled via the clip component and the clip receiving component.

2. The door of claim 1, wherein the inner frame is dimensioned to fit within the outer frame.

3. The door of claim 1, further comprising a hinge receiving component molded into the inner frame.

4. The door of claim 1, wherein at least one of the inner frame and outer frame comprises a polymer.

5. The door of claim 1, wherein at least one of the inner frame and outer frame comprises a metal.

6. A method of assembling a door, comprising:

providing a one piece molded outer frame including a framing member having a front edge, an inner face, a back edge, and a clip component, the clip component including, an anchor section attached to the inner face of the outer frame framing member;

an engaging section including an inner face, a front edge, and a back edge, the front edge of the engaging section attached to the anchor section and extending generally parallel to the inner face of the outer frame; and a wedge-shaped locking section having a wide end and a narrow end, the locking section being attached to the inner face of the engaging section and being oriented such that the wide end extends further from the inner face of the engaging section than the narrow end;

a one piece molded inner frame having a front face, a back face, an outer edge, an inner edge, and a clip receiving component, the clip receiving component including, an aperture extending from the outer edge of the inner frame framing member and a lip configured to lock the clip component into the clip receiving component; and a transparent panel; and securing the transparent panel between the outer frame and the inner frame, the outer frame and inner frame being coupled via the clip component and the clip receiving component.

* * * * *